United States Patent [19]

Lee

[11] Patent Number: 4,717,104

[45] Date of Patent: Jan. 5, 1988

[54] WALL BRACKET WITH ADJUSTABLE MOUNTING FACE

[75] Inventor: E. Desmond Lee, St. Louis, Mo.

[73] Assignee: Lee-Rowan Company, St. Louis, Mo.

[21] Appl. No.: 827,365

[22] Filed: Feb. 7, 1986

[51] Int. Cl.[4] ..... A47G 29/02

[52] U.S. Cl. ..... 248/235; 248/241; 248/249; 211/90; 108/108; 108/103

[58] Field of Search ..... 248/235, 249, 250, 239, 248/240, 241, 242; 211/90, 134; 108/152, 42, 159, 108, 103

[56] References Cited

U.S. PATENT DOCUMENTS

| | | | |
|---|---|---|---|
| 1,576,784 | 3/1926 | Planett | 248/235 X |
| 2,467,681 | 4/1949 | McKinney | 248/239 |
| 3,598,064 | 8/1971 | Stempel | 248/249 X |
| 3,637,085 | 1/1972 | Ball | 211/153 |
| 3,637,183 | 1/1972 | Sagers | 248/235 |
| 4,318,487 | 3/1982 | McCarthy | 248/249 X |

FOREIGN PATENT DOCUMENTS

| | | | |
|---|---|---|---|
| 510870 | 5/1952 | Belgium | 211/153 |

*Primary Examiner*—Ramon S. Britts
*Assistant Examiner*—Karen J. Chotkowski
*Attorney, Agent, or Firm*—Rogers, Howell, Moore & Haferkamp

[57] ABSTRACT

A wall bracket for mounting a shelf within an area defined by two walls that intersect at an angle deviating from ninety degrees. The wall bracket has a cradle section and an integral back plate. The cradle section supports a side portion of a shelf. The back plate is convex to allow rotation of the wall bracket about a generally vertical axis, and elongated slots in the back plate to receive wall fasteners.

11 Claims, 6 Drawing Figures

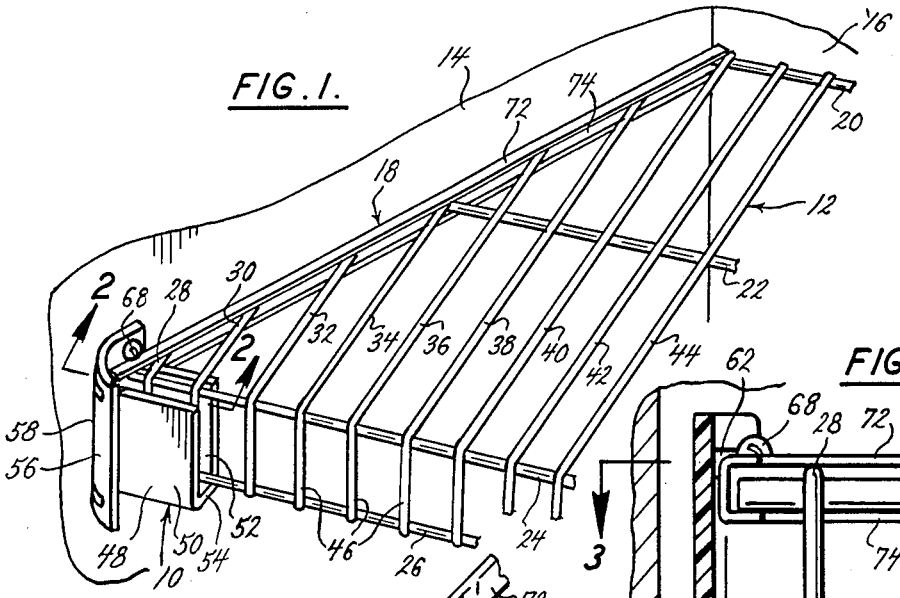
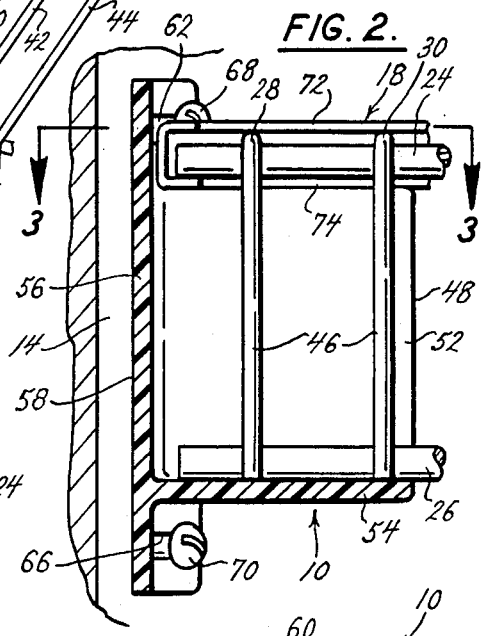
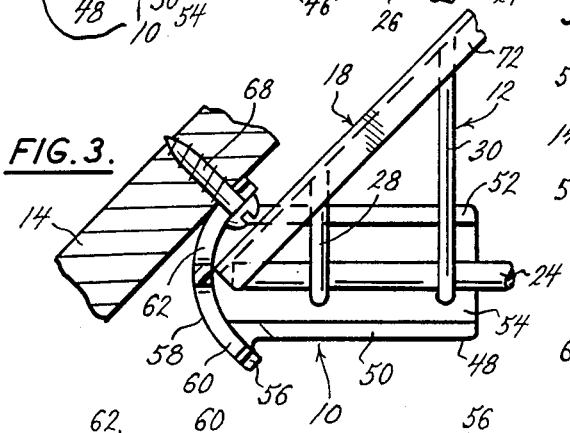
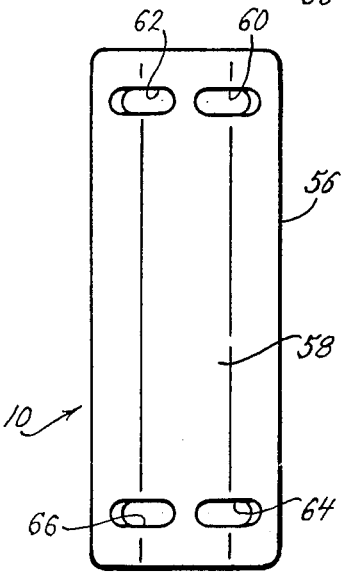
FIG. 4.
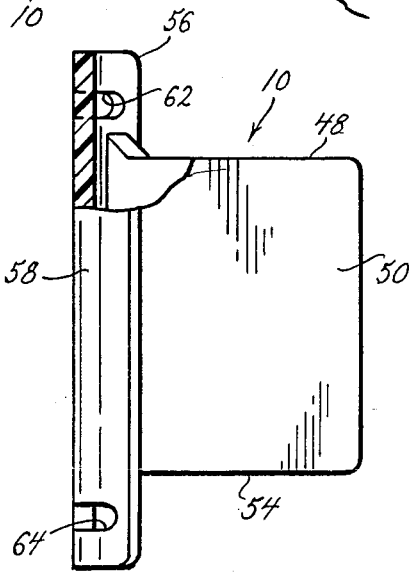
FIG. 5.
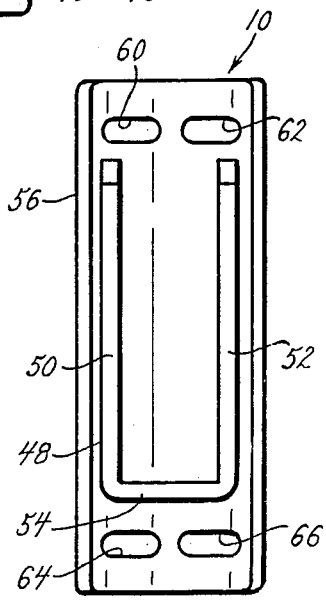
FIG. 6.

WALL BRACKET WITH ADJUSTABLE MOUNTING FACE

BACKGROUND OF THE INVENTION

This invention relates to a wall bracket for supporting a shelf and particularly to such a wall bracket that has a convex wall mounting plate adapting the wall bracket for mounting to a side wall that intersects a back wall at other than a ninety degree angle.

Wall brackets incorporating a cradle for supporting the side of a shelf are known in the prior art. These wall brackets typically have a mounting or back plate by which the wall bracket is mounted to a side wall, such as the side wall of a closet. The mounting plate is typically flat with the plane of the back plate at right angles to the shelf, and to the back wall of the closet.

While the existing wall brackets work well when the side wall of the closet is at right angles to the back wall, these existing wall brackets are not designed to compensate for variations from such ninety degree angles. However, in contemporary house construction, it is not uncommon for one or both side walls of the closet to intersect the back wall at an angle of other than ninety degrees. Sometimes that angle of intersection is an obtuse angle, such as 135°, and sometimes it is an acute angle. The wall bracket of this invention accommodates any of a wide range of variations from obtuse to acute of the angle of intersection between the side wall and the back wall.

SUMMARY OF THE INVENTION

In summary, the invention comprises a wall bracket preferably of unitary molded plastic, having a cradle that extends from a convex mounting plate. The cradle is defined by a bottom wall and spaced side walls extending upwardly therefrom. The top and free end of the cradle are open to receive a side margin of the vertical front of a shelf. The mounting plate is convex, preferably in the form of a segment of a cylinder, but alternatively, the mounting plate can be formed as a series of flat faces at angles to one another and arranged in a general convex shape. There are two vertically spaced rows of holes through the mounting plate. These may be in the form of horizontal slots or alternatively in the form of a plurality of holes. In any of these hole arrangements, the two rows of holes accommodate mounting screws over substantially the entire width of the mounting plate so that the wall bracket can be mounted to a side wall and project therefrom at any one of a wide range of angles.

The invention also contemplates use of the wall bracket with an existing metal or plastic shelf of the kind having parallel support rods that support a plurality of parallel shelf rods. If the shelf were used in a closet having side walls normal to the back wall, one of the shelf rods would define the side of the shelf. However, to fit in a closet having walls that intersect at other than a ninety degree angle, the shelf rods and the support rods must be cut or clipped, leaving exposed rod ends. Pursuant this invention, a channel, preferably of extruded plastic, is provided for fitting over the exposed ends of the rods and being positioned between the shelf and the side wall. The channel member can be provided in a length greater than normally needed so that the installer can readily cut it to the desired length to accommodate a particular installation.

BRIEF DESCRIPTION OF THE DRAWINGS

FIG. 1 is an isometric view showing the wall bracket and a portion of a shelf with the wall bracket mounted to a side wall and supporting one end of the front of the shelf;

FIG. 2 is an enlarged view in section taken along the plane of the line 2—2 of FIG. 1;

FIG. 3 is a view in section taken along the plane of the line 3—3 of FIG. 2;

FIG. 4 is an enlarged rear view of the wall bracket;

FIG. 5 is an enlarged side elevation view of the wall bracket with a portion shown in section; and FIG. 6 is an enlarged front elevation view of the wall bracket.

DETAILED DESCRIPTION OF PREFERRED EMBODIMENT

This wall bracket 10 is adapted to be used to mount a shelf 12 in an area, such as a closet, having a side wall 14 and a rear wall 16 (normally with another side wall opposite the side wall 14). In housing construction, the side wall 14 has typically been built at a right angle to the back wall 16, but this is not always the case, and buildings are being constructed and have been constructed wherein the side wall 14 intersects the back wall 16 at an angle that is a significant deviation from a ninety degree angle, both as an obtuse angle and as an acute angle. This wall bracket 10 is provided to enable mounting the shelf 12 in spite of such deviations from a ninety degree angle between the side and back walls 14 and 16. Also, as will be more fully explained, it is desirable to provide a cover for exposed wire ends, and for this purpose, the invention contemplates the provision of a channel member 18.

The shelf 12 may be of various designs. The drawings illustrate a typical shelf 12 of a conventional kind that has spaced parallel support rods extending from side to side, including a rear rod 20, a central rod 22, and upper and lower front rods 24 and 26. Fastened to these support rods are a plurality of spaced cross rods or shelf rods 28, 30, 32, 34, 36, 38, 40, 42 and 44 as shown in the partial view of the shelf 12, and the number of shelf rods will vary according to the width of the shelf. Each of the shelf rods 28–44 has a downwardly extending front section 46 connected to both the front support rods 24 and 26. The rods 28–44 are welded or otherwise secured to the support rods 22, 24, and 26. The shelf 12 is supported on the back wall 16 by a plurality of back clips (not shown) as known in the art.

The wall bracket 10 is formed as a single unitary component, preferably of molded plastic, and includes a cradle 48 comprising spaced side walls 50 and 52 and a bottom wall 54 extending from a mounting plate 56. The cradle is adapted to receive the side of the front of the shelf 12 as shown in the drawings and as is known in the art.

The mounting plate 56 is curved to form a segment of a cylinder on a generally vertical axis so that, regardless of the angle of intersection of the side wall 14 with the back wall 16, a portion of the rear face 58 of the mounting plate 56 will be in contact with the side wall 14. In the illustration of FIG. 1, the side wall 14 is at an obtuse angle to the back wall 16 in the range of 135 degrees, yet the curvature of the back plate 56 allows it to bear against the side wall 14, thereby providing a bearing surface, with the cradle 48 aligned with and receiving a side margin of the front of the shelf 12.

In the embodiment shown, there are two horizontally aligned elongated slots 60 and 62 toward the upper end of the mounting plate 56 and two horizontally aligned slots 64 and 66 toward the lower end of the mounting plate 56. The wall bracket 10 is mounted to the side wall 14 by two screws 68 and 70, one of which extends through one of the upper slots 60 or 62 with the other screw extending through one of the lower slots 64 or 66. (The screws extend through the slots 62 and 66 in the mounting illustrated.) These elongated slots 60, 62, 64 and 66 allow the screws to be driven straight into the side wall 14 in almost any angle of orientation of the wall bracket 10 relative to that wall. It will be understood that, if desired, the slots 60 and 62 could be merged into one slot as could the slots 64 and 66, or the slots could be replaced by a plurality of horizontally aligned round holes.

Contrary to what is shown in FIG. 1, the conventional shelf 12 has shelf wires 28–44 of equal length, and all extend all the way to the rear support wire 20. To fit within the corner defined by the intersection of the side wall and the rear wall 16, part of the rear support wire 20 must be cut and the wires 28, 30, 32, 34, 36 and 38, in the illustration, must be cut to graduated lengths as shown. This would leave exposed ends of the shelf wires 28–38. To cover these exposed ends, the plastic channel extrusion 18 is fitted over the exposed ends and cut to the appropriate length to extend between the rear support wire 20 and the front support wire 24. The channel member 18 bears against the side wall 14 and is held by the shelf wires 28–38. To facilitate handling, it is desirable that the sides 72 and 74 of the channel member 18 be sprung inwardly so that they press against the rods 28–38.

INSTALLATION AND USE

The user is confronted with a space, such as a closet space, wherein the side wall 14 is not at a ninety degree angle to the back wall 16. The standard shelf 12 must be cut as previously described to fit the corner. If the angle defined by the intersection of the walls 14 and 16 is obtuse, such as about 135 degrees, the back wire 20 is cut and the shelf wires 28–38 are cut to progressively increasing lengths to create a new side wall of the shelf 12 that is at approximately the same angle to the back wire 20 as the angle between the side wall 14 and back wall 16. Next, the channel member 18 is cut to an appropriate length and snapped onto the exposed ends of the shelf rods 28–38.

The wall bracket 10 is aligned to the side wall 14 so that the cradle 48 extends outwardly therefrom parallel to the back wall 16, (and is properly spaced from the back wall 16). Because the mounting plate 56 is arcuate, and even though the wall bracket 10 as thus oriented is not at a ninety degree angle to the side wall 14, a portion of the face 58 will be in contact with the side wall 14. Likewise, because of the elongated slots 60, 62, 64 and 66, portions of the slot openings will also be positioned directly opposite the wall 14, enabling the screws 68 and 70 to be passed through the slots and threaded into the wall 14, mounting the wall bracket 10 in place.

The back clips (not shown) can be installed on the wall 16 to support the rear support rod 20, and the side of the front of the shelf 12 can be supported within the cradle 48, as shown in the drawings.

There are various changes and modifications which may be made to this invention as would be apparent to those skilled in the art. However, any of these changes or modifications are included in the teaching of this disclosure and this invention is limited only by the scope of the claims appended hereto.

What I claim is:

1. A wall bracket for supporting a shelf or the like to a wall comprising: a shelf support section and a mounting plate joined together, the shelf support section including means to support a portion of a shelf, the mounting plate comprising a member having arcuately oriented contact surfaces selectively engageable with the surface of a wall and having a side opposite the contact surfaces, the shelf support section projecting from the side of the member opposite the contact surfaces to allow variation about a vertical axis of the angle of projection of the shelf support section from the wall while retaining contact between a contact surface and the wall, and means for mounting the wall bracket to a wall at a selected angle of projection, and opening defining means through the mounting plate elongated in a direction transverse to the axis for receiving the means for mounting at a plurality of locations along the opening defining means.

2. The wall bracket of claim 1 wherein the opening defining means comprises elongated slots.

3. The wall bracket of claim 1 wherein the shelf support section comprises a cradle having a bottom wall and spaced side walls.

4. The wall bracket of claim 1 wherein the shelf support section and the mounting plate are of unitary molded plastic construction.

5. The wall bracket of claim 6 wherein the channel member is extruded plastic.

6. The wall bracket of claim 1 combined with an elongated channel member for receiving the exposed cut ends of shelf rods.

7. A wall bracket for mounting a shelf in a generally horizontal position within an area defined by two intersecting walls wherein the shelf has a downwardly extending front edge and wherein the angle of intersection between the two intersecting walls may deviate from ninety degrees by an amount not predetermined, the wall bracket comprising a cradle extending from a mounting plate, the cradle having a bottom and generally vertical side walls for receiving a side margin of the front edge therewithin, the mounting plate being generally convex about a generally vertical axis to define a generally convex surface and a generally concave surface, the cradle projecting outwardly from the concave surface to allow rotation of the wall bracket about said axis to compensate for said angle deviation, and means to mount the mounting plate to one of the walls.

8. The wall bracket of claim 7 wherein the shelf is of the kind normally having a ninety degree corner so that a modified side edge must be provided on the shelf to enable the shelf to fit within the area defined by the two intersecting walls, the improvement including a channel member for covering the modified side edge.

9. The wall bracket of claim 8 wherein the shelf is the kind defined by rods and the modified edge is defined by cut ends of at least some of the rods, the channel member having spaced side walls for receiving the cut ends of the rods.

10. The wall bracket of claim 9 wherein the channel member is plastic and the side walls of the channel member are biased toward one another to releasably grip the rod ends.

11. The wall bracket of claim 7 including vertically spaced generally horizontal elongated slots in the mounting plate for receiving screws therethrough.

* * * * *